US007364102B2

(12) United States Patent
Engel et al.

(10) Patent No.: US 7,364,102 B2
(45) Date of Patent: Apr. 29, 2008

(54) PILL CRUSHER WITH GEAR RACK

(75) Inventors: Mark Engel, Encino, CA (US); Song Yang, Shanghai (CH); Dong Du, Shanghai (CH)

(73) Assignee: Tiger Medical Products (U.S.), Inc., Encino, CA (US)

( * ) Notice: Subject to any disclaimer, the term of this patent is extended or adjusted under 35 U.S.C. 154(b) by 59 days.

(21) Appl. No.: 11/511,030

(22) Filed: Aug. 28, 2006

(65) Prior Publication Data

US 2008/0061175 A1 Mar. 13, 2008

(51) Int. Cl.
*B02C 19/00* (2006.01)

(52) U.S. Cl. ..... 241/169; 241/262; 241/DIG. 27

(58) Field of Classification Search ..... 241/DIG. 27, 241/101.2, 169, 262, 283; 100/288, 292
See application file for complete search history.

(56) References Cited

U.S. PATENT DOCUMENTS 2,526,273 A * 10/1950 Rimes ..... 30/120.5
3,915,393 A 10/1975 Elkins ..... 241/168
4,763,847 A 8/1988 Vosburgh ..... 241/169
5,118,021 A 6/1992 Fiocchi ..... 225/103
5,169,076 A * 12/1992 Dols ..... 241/169
5,531,386 A 7/1996 Jensen ..... 241/36
5,915,637 A 6/1999 Parsons ..... 241/168
5,944,243 A 8/1999 Weinstein ..... 225/93
6,474,525 B1 11/2002 Reitano ..... 225/1
6,527,155 B2 3/2003 Buckley et al. ..... 225/1
6,601,746 B2 8/2003 Buckley et al. ..... 225/103
D497,543 S 10/2004 Buckley ..... D9/302

* cited by examiner

*Primary Examiner*—Mark Rosenbaum
(74) *Attorney, Agent, or Firm*—Fattibene & Fattibe; Paul A. Fattibene; Arthur T. Fattibene

(57) ABSTRACT

A pill crusher having a rack and pinion advancing a platen. Pill crushers are used to crush pills into powder for various medicinal reasons, such as ease of mixing or dosing. A rack on a slide way is linearly advanced by rotational movement of a pinion on a handle. The slide way is attached to a platen that advances towards an anvil. A pill in a pouch placed adjacent the anvil is crushed by the advancing platen. In one embodiment, a shaped anvil insert surface is mated to a complementary shaped platen surface and aids in crushing the pill. The present invention provides an efficient and sturdy pill crusher for commercial as well as personal use.

16 Claims, 4 Drawing Sheets

PILL CRUSHER WITH GEAR RACK

FIELD OF THE INVENTION

This invention relates generally to a pill crushing apparatus, and more particularly to a pill crushing apparatus having a mechanical advantage utilizing a gear-lever-rack system. It is intended to give an effective solution to the care providers or patients who need to crush pills to form powders for particular medicament purposes.

BACKGROUND OF THE INVENTION

In many cases, medicines come in the form of pills or tablets. Often, neither of these forms meets clinical application requirements. In some cases, the sizes of the pills or tablets are too big to easily swallow in their whole form or too strong a dosage in some cases. For example, many patients such as children, some geriatrics, or other patients with particular diseases have difficulty swallowing whole pills or tablets. Hence it has been recognized that there is a need in these circumstances to crush pills or tablets of medicines into powder and then mix them with food, such as applesauce or jelly or add to a liquid in order to be easily swallowed or better digested. A number of "pill crushers" are currently available on the marketplace for both professional healthcare providers and the general population for personal use.

Conventional pill crushers rely on various operational mechanisms including the use of a mortar and pestle for grinding or impacting. Additionally, there have been various manual or motor driven devices to abrade, compress, fracture or crush the pills or tablets into either fragments or powder. However, all of the current commercial products have certain weaknesses in terms of reliability and efficacy of crushing pills or tablets, particularly for professional care providers which require heavy duty solutions.

For example, U.S. Pat. No. 5,915,637, issued on Jun. 29, 1999 to J. Stuart Parsons, discloses a pill crusher whose operating mechanism is to convert the rotational movement of the handle into the "V" movement of the plates that is pivotally connected with the handle and the base for crushing pills between the plates and the anvil which is vertically fixed to the elongated base. A pouch for receiving the pills to be crushed has also been provided with the apparatus. In this prior apparatus, the crushing action from the "V" movement of the plates to the anvil is not sufficient to pulverize the pills into desired powders in a single action. Repetition is inevitable to get the desired powder. In addition, it is difficult to clean the crushing area during regular maintenances or if the pill pouches are accidentally caused to split. As a result, cross contamination of medicines is possible due to the difficulty in cleaning.

Therefore, with consideration to the previous discussion of the prior art, there is a need for a device that is compact and universal in design for crushing the various pills or tablets, and that operates in an easy but reliable, quiet, effort saving and efficient manner, and is easy to maintain and clean, and is suitable for both individual and institutional usage, and effectively reduces the likelihood of the contamination of the pills or tablets.

In summary, there is a need for a pill crusher to overcome most of the shortcomings of existing devices. There is a need for an apparatus that is easy to use, strong, reliable, and easy to clean and maintain.

SUMMARY OF THE INVENTION

The invention disclosed herein simply meets all the above requirements and provides a one-stop solution to pill or tablet crushing, particularly for professional care providers. A gear-lever-rack combination is used to uniformly advance a platen to crush pills in a pouch against an anvil.

The preferred embodiment of the present invention is a pill crusher that has a molded rectangular base integrally with a vertical enhanced anvil at one end, a gear-lever-rack transmission system in the middle, and a pouch dispenser at the other end. The gear-lever is fixed between two supports on the base by an axle and is mated with a rack that can move back and forth along a slide way attached to the base. The rotation of the gear-lever is translated into the linear movement of the mated rack along the slide way. The force moves a platen that is attached at one end of the rack for crushing pills placed in a pouch against the anvil. The curved or shaped surfaces of the anvil and the mating platen provide assistance in crushing the pills into a fine powder. Different replaceable or fixed anvils and platens may be used that have different curved or shaped surfaces.

A number of advantages are credited to the preferred embodiment of the invention. Firstly, it affords the users substantial mechanical benefits from the gear-lever-rack system since it provides a strength-saving and ergonomic way to operate. Secondly, the horizontal movement of the platen prevents the pills from sliding in the pouch and leaves enough space for cleaning the working area. Thirdly, the mating curved or shaped platen and anvil helps crush the pills into a fine powder in an efficient way. In short, this pill crusher's reliability, efficacy, flexibility, and ease of use and maintenance enable the users a superior manner of pill crushing, particularly in a commercial or institutional environment.

Accordingly, it is an object of the present invention to provide a pill crusher that is efficient and easy to use.

It is another object of the present invention to provide a pill crusher that is relatively mechanically simple yet very strong.

It is an advantage of the present invention that the gearing of the rack and pinion can be easily adjusted to provide different degrees of force and linear travel by changing the pitch of the gears.

It is an advantage of the present invention that it is easily disassembled for cleaning.

It is a feature of the present invention that a gear-lever-rack mechanism is used to convert rotational motion to linear motion.

It is a feature of the present invention that a shaped anvil and mating shaped platen is used.

It is a feature of an embodiment of the present invention that an anvil and platen has mating array surfaces consisting of a plurality of concave and convex portions.

It is yet another feature of the present invention that a pouch storage container is located adjacent the handle end.

These and other objects, advantages, and features of the present invention will become more fully apparent from the following drawings, detailed description and appended claims.

DETAILED DESCRIPTION OF THE PREFERRED EMBODIMENT

The preferred embodiment of the present invention described below is simply for illustrative purpose and is not intended to be restricted to other forms that do not depart from its essentials. Reference numbers indicated in the accompanying drawings illustrate the components, structure, and operation mechanism of the preferred embodiment of the invention. The numeral 10 is directed to the whole apparatus according to one embodiment of the present invention.

Figure 1:
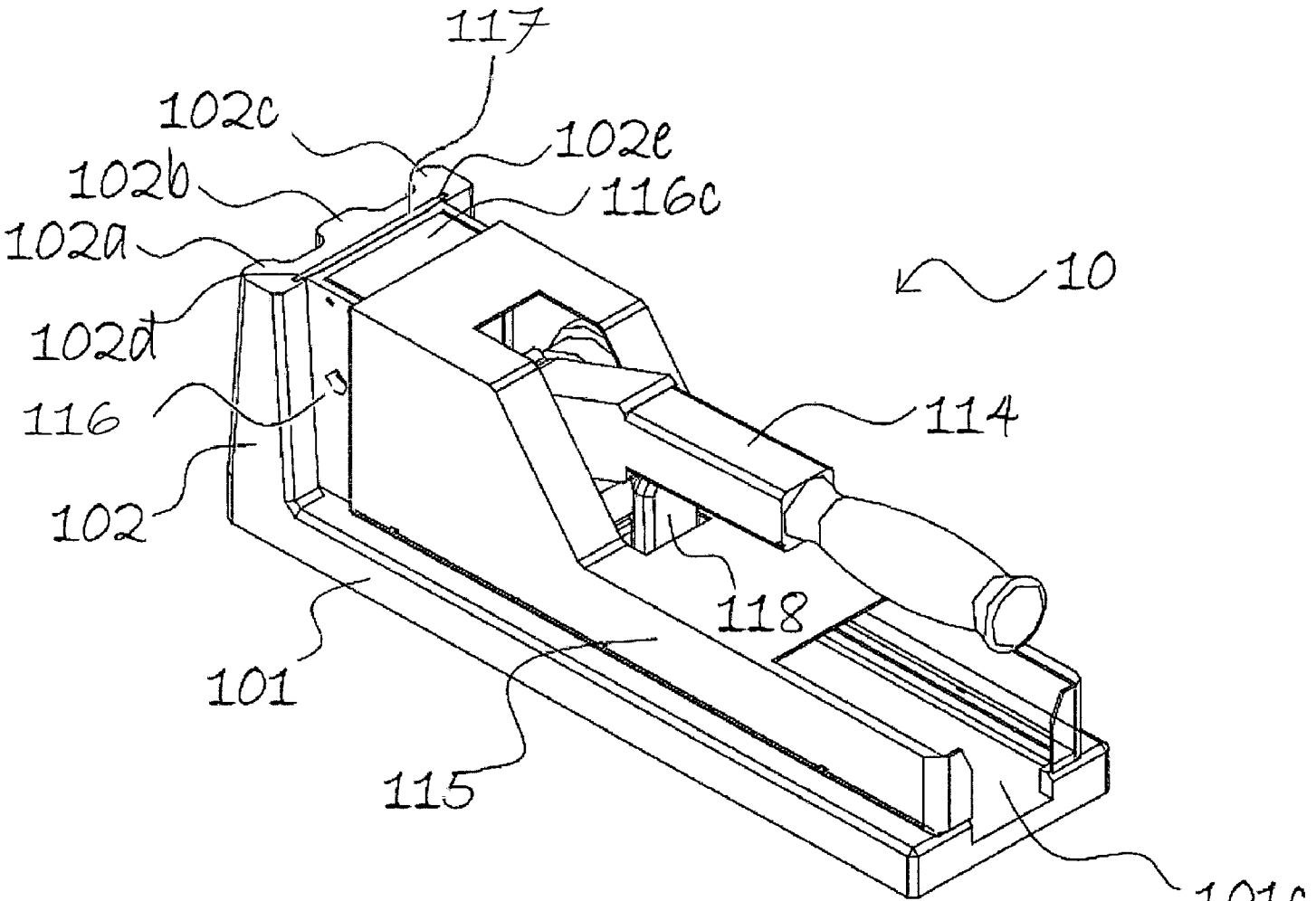
FIG. 1 is a perspective view illustrating the present invention.
Figure 2:
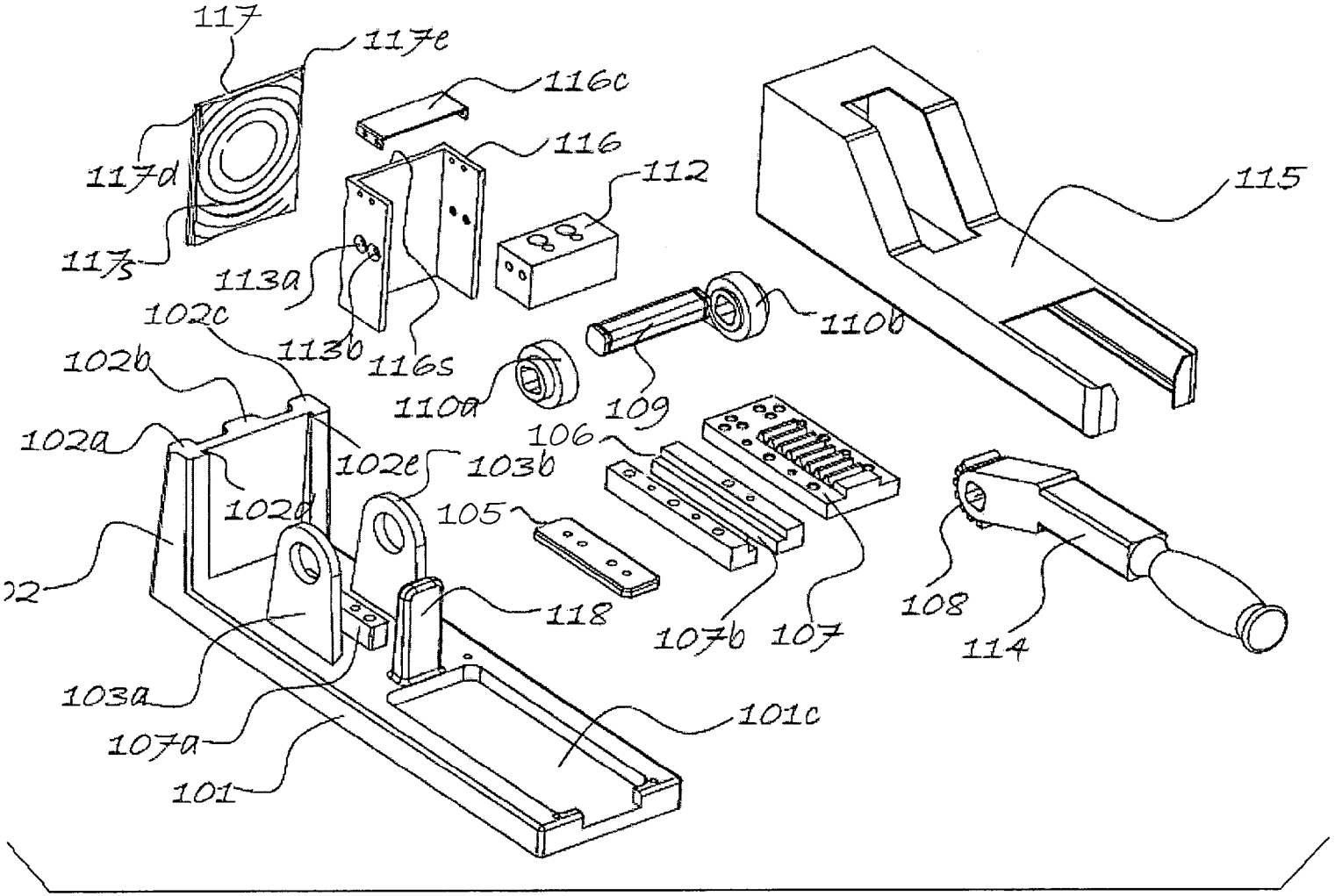
FIG. 2 is an exploded view illustrating the present invention.
Figure 3:
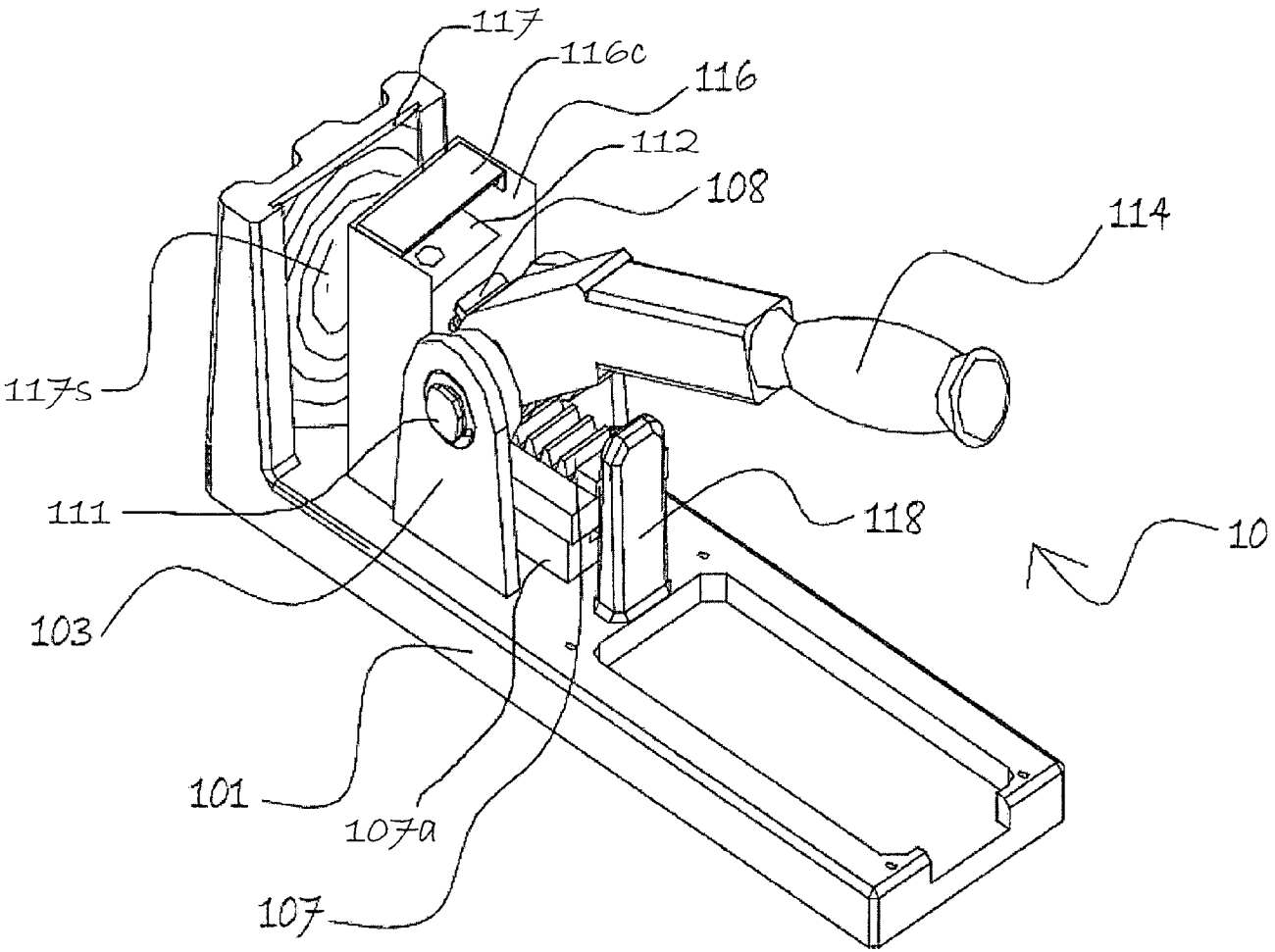
FIG. 3 is a perspective view illustrating the present invention without a cover.

The main components of the apparatus are illustrated in FIGS. 1-3. The pill crusher 10 includes a rectangular base 101 with an integral anvil support 102 at one end, a gear-lever-rack system in the middle, and a cover 115. Three ridges 102*a*, 102*b*, 102*c* at the outside surface of the anvil support 102 provide extra support and improved rigidity. Two stands or supports 103*a* and 103*b* support the gear-lever-rack system. The base slider top support 107*a* is attached to the base 101. A base support top slide way 105 is attached to the base slider top support 107*a*. The rack support and slide way 107*b* is coupled to the base support top slide way 105. The rack slide way shoulder 106 retains the base support top slide way 105. Therefore, the rack 107 attached to the rack support and slide way 107*b* retains the base support top slide way 105 between it and the rack slide way shoulder 106. This permits the rack 107 to be held to the base 101 and yet linearly slide along the longitudinal axis of the base.

Meshing with the rack 107 is a geared-wheel or pinion 108. The geared-wheel or pinion rotates along with an axle 109 and two special rings 110*a* and 110*b* in the two holes of the stands or supports 103*a* and 103*b*. A handle 114 is attached to the axle 109 to control the rotation movement of the gear wheel or pinion 108. The axle 109 is keyed to the gear wheel or pinion 108. The cross sectional shape of the axle 109 may be square and mate with a square hole in the handle 114. A bolt 111 holds the axle 109 in place.

A platen 116 is fixed at one end of the rack 107 adjacent the anvil 102. A rectangular box 112 is connected to the platen 116 by two screws, not shown, placed in the two screw holes 113*a* and 113*b* and is affixed to the rack 107 below for enhancing the rigidity of the apparatus and for balancing the forces on the platen 116. The anvil support 102 has two grooves 102*d* and 102*e*. An anvil insert 117 is placed between the two grooves 102*d* and 102*e*. The anvil insert 117 has an anvil insert surface 117*s*. The platen surface 116*s* and the anvil insert surface 117*s* are matched together to create enhanced pill crushing. In this embodiment the platen surface 116*s* and the mating anvil insert surface 117*s* are formed of concentric circles. However, other mating shapes may be used.

A stopper 118 is in the middle part of the base 101 to prevent damage to the handle 114, rack 107, or other parts from over-rotation. A cover 115 hides most of the gear-lever-rack system. The cover 115 has an opening in combination with a pouch storage recess 101*c* formed in the base 101 that functions as a pouch dispenser for holding the pouches used for pill crushing.

The operation of the device will now be discussed. The device utilizes the rotation movement of the geared wheel or pinion 108 to create the pushing force for the mated rack 107. The rotation force is converted into forward or linear movement of the rack 107 along the rack support and slide way 107*b* held by the base 101. This causes the attached platen 116 to move linearly towards the anvil insert 117 for crushing the pills contained in pouches, not shown, placed there between. The longitudinal axis if the handle 114 may be offset to provide a more comfortable or efficient motion.

Figures 4A, 4B, 4C:
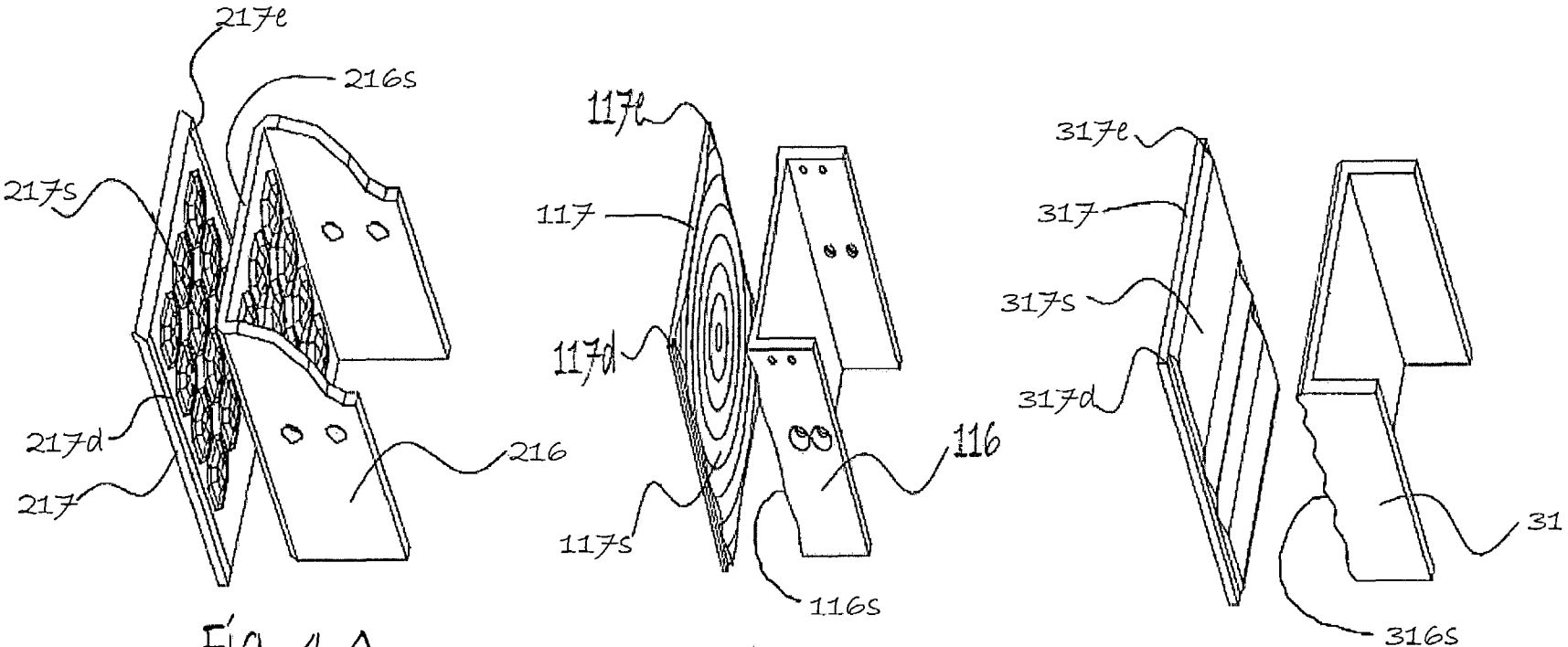
FIG. 4A is a perspective view of a mating anvil and platen having an array of concave and convex portions.
FIG. 4B is a perspective view of a mating anvil and platen having concentric circles.
FIG. 4C is a perspective view of a mating anvil and platen having linear ridges.

FIGS. 4A-C illustrate different shaped embodiments for the anvil inserts and the platens. In the embodiment illustrated in FIG. 4A, the anvil insert 217 with a surface 217*s* and platen 216 with a surface 216*s* each have an array surface of a plurality of mating concave and convex portions. The plurality of mating concave and convex portions aid in holding and crushing the pills or tablets placed there between. The anvil insert shoulders 217*d* and 217*e* slide in the anvil grooves 102*d* and 102*e* illustrated in FIG. 1. FIG. 4B better illustrates the anvil insert 117 and platen 116 illustrated in FIGS. 1-3. The anvil insert shoulders 117*d* and 117*e* slide in the anvil grooves 102*d* and 102*e* illustrated in FIG. 1. FIG. 4C illustrates another embodiment of a shaped anvil insert 317 and platen 316 having a surface 316*s*. In the embodiment illustrated in FIG. 4C, the shaped surfaces are mating linear ridges. The anvil insert shoulders 317*d* and 317*e* slide in the anvil grooves 102*d* and 102*e* illustrated in FIG. 1.

From the foregoing description, it is clear that the current invention provides a compact platform for crushing pills or tablets primarily for commercial, industrial, or institutional use, but is also easy enough for personal use. It is ergonomically simple and reliable to operate.

While the present invention has been described with respect to several different embodiments, it will be obvious that various modifications may be made without departing from the spirit and scope of the invention.

What is claimed is:

1. A pill crusher comprising:

a base;

a base slide way held by said base;

a rack slide way engaging with said base slide way so as to permit relative linear movement there between;

a rack attached to said rack slide way;

a handle pivotally attached to said base;

a pinion attached to one end of said handle and adapted to mate with said rack;

a platen attached to said rack; and an anvil attached to said base, whereby when said handle is moved, said pinion meshes with said rack causing said platen to advance towards said anvil crushing a pill placed there between.

2. A pill crusher as in claim 1 wherein said anvil further comprises:

a removable anvil insert.

3. A pill crusher as in claim 2 wherein:

said removable anvil insert and said platen have mating shapes surfaces.

4. A pill crusher as in claim 3 wherein:

the mating shaped surfaces comprise an array of a plurality of mating concave convex portions.

5. A pill crusher as in claim 3 wherein:

the mating shaped surfaces comprise concentric circles.

6. A pill crusher as in claim 3 wherein:

the mating shaped surfaces comprise linear ridges.

7. A pill crusher as in claim 1 further comprising:

a pouch dispenser formed on said base under said handle.

8. A pill crusher comprising:

a base;

a slide way attached to said base;

an anvil support;

an anvil insert having a shaped surface;

a rack coupled to said slide way, whereby said rack is permitted to move linearly towards said anvil;

a gear wheel mating with said rack;

a handle attached to said gear wheel; and a platen having a complementary shaped surface mating with the shaped surface of said anvil insert and attached to said rack, whereby when said handle is moved said gear wheel rotates causing said rack and attached platen to advance towards said anvil insert crushing a pill placed there between.

9. A pill crusher as in claim 8 wherein:

the shaped surface and the complementary shaped surface comprise an array of a plurality of mating concave convex portions.

10. A pill crusher as in claim 8 wherein:

the shaped surface and the complementary shaped surface comprise concentric circles.

11. A pill crusher as in claim 8 wherein:

the shaped surface and the complementary shaped surface comprise linear ridges.

12. A pill crusher as in claim 8 further comprising:

a pouch dispenser formed on said base under said handle.

13. A device for providing a mechanical advantage in crushing a pill comprising:

a base;

an integrally formed anvil support extending substantially perpendicularly from said base on one end;

a pouch storage recess formed in said base at another end;

a pair of opposing stands formed in said base;

a base slide way support formed in said base between said integrally formed anvil and said pouch storage recess;

a rack support and slide way having a shoulder placed over said base slide way support;

a base support top slide way placed over the shoulder and attached to said base slide way support, whereby said rack support and slide way is retained to said base and permitted to slide along a longitudinal axis of said base towards and away from said integrally formed anvil;

a rack attached to said rack support and slide way;

a handle pivotally attached to said pair of opposing stands;

a pinion coupled to said handle and mating with said rack, whereby upon rotation of said handle, said rack is caused to move linearly;

a platen having a shaped surface attached to said rack;

an anvil insert having a complementary shaped surface mating with the shaped surface placed adjacent said integrally formed anvil support; and a cover attached to said base, whereby rotational motion of said handle is converted to linear motion advancing said platen against said anvil insert so as to crush a pill placed in a pouch there between.

14. A device for providing a mechanical advantage in crushing a pill as in claim 13 wherein:

the shaped surface and the complementary shaped surface comprise an array of a plurality of mating concave convex portions.

15. A device for providing a mechanical advantage in crushing a pill as in claim 13 wherein:

the shaped surface and the complementary shaped surface comprise concentric circles.

16. A device for providing a mechanical advantage in crushing a pill as in claim 13 wherein:

the shaped surface and the complementary shaped surface comprise linear ridges.

* * * * *